US007036778B2

(12) United States Patent
Ferrell

(10) Patent No.: US 7,036,778 B2
(45) Date of Patent: May 2, 2006

(54) TABLEWARE CLIP-ON DEVICE

(76) Inventor: Janis I. Ferrell, 355 - 12th Ave., Indian Rocks Beach, FL (US) 33785

( * ) Notice: Subject to any disclaimer, the term of this patent is extended or adjusted under 35 U.S.C. 154(b) by 0 days.

(21) Appl. No.: 11/038,994

(22) Filed: Jan. 20, 2005

(65) Prior Publication Data

US 2005/0145763 A1 Jul. 7, 2005

Related U.S. Application Data

(62) Division of application No. 10/726,818, filed on Dec. 3, 2003, now abandoned.

(51) Int. Cl.
*F21V 35/00* (2006.01)

(52) U.S. Cl. ..... 248/213.2; 248/229.16; 248/288.31; 248/316.7; 40/324; 40/658

(58) Field of Classification Search ..... 248/447.1, 248/447.2, 453, 229.16, 229.2, 230.7, 231.81, 248/288.31, 288.51, 316.7, 213.2, 37.3, 37.6; 40/324, 658, 666; 220/735
See application file for complete search history.

(56) References Cited

U.S. PATENT DOCUMENTS

| | | | | | |
|---|---|---|---|---|---|
| 363,525 | A | | 5/1887 | Lipp | |
| 1,261,894 | A | * | 4/1918 | Barnes | 248/288.51 |
| 1,590,227 | A | * | 6/1926 | Britton | 248/103 |
| 1,671,085 | A | * | 5/1928 | Nuernberg | 248/103 |
| 1,688,148 | A | * | 10/1928 | Martin | 248/229.12 |
| 1,987,071 | A | | 1/1935 | Luft | |
| 2,496,478 | A | * | 2/1950 | Kinnebrew | 248/103 |
| 2,658,297 | A | | 11/1953 | Woolsey | |
| 2,950,836 | A | * | 8/1960 | Murdock | 220/576 |
| 3,351,312 | A | * | 11/1967 | Ballas | 248/448 |
| 4,307,864 | A | | 12/1981 | Benoit | |
| 4,482,117 | A | * | 11/1984 | Besek, Jr. | 248/103 |
| 5,645,254 | A | | 7/1997 | Ng et al. | |

* cited by examiner

*Primary Examiner*—Korie Chan
(74) *Attorney, Agent, or Firm*—Larson & Larson, PA; Herbert W. Larson

(57) ABSTRACT

A C-ring clips to an edge of tableware. The C-ring has a rearwardly extending shaft supporting a ball. A gripping device rotates on the ball and supports a shelf. A fixture capable of displaying an ornament or name card is attached to the shelf.

3 Claims, 2 Drawing Sheets

TABLEWARE CLIP-ON DEVICE

PRIOR APPLICATIONS

This application is a divisional of U.S. Ser. No. 10/726,818, filed on Dec. 3, 2003 now abandoned.

BACKGROUND OF THE INVENTION

This invention relates to a movable holding device attached to a ball supported by a shaft. More particularly, it refers to a clip-on device for tableware whereby nameplates or decorative devices are attached to the tableware.

It is known in the prior art to have a movable picture holder supported on a ball as shown in U.S. Pat. No. 363,525. Clips have been used as flower holders as shown in U.S. Pat. No. 1,987,071 and cake plate decorating items have been clipped to plates as shown in U.S. Pat. No. 2,658,297. Name plates and decorative items have been associated with dinnerware usually by placing them adjacent to a dinner plate or glass. Such name plates are common in restaurants for reserving a space for customers. By placing them adjacent to a plate or glassware, the name plate can be mixed up or covered over by other tableware. A need exists for a device that will attach to tableware and not be covered over or disturbed from its proper identifying position.

SUMMARY OF THE INVENTION

The problem of misplaced or covered over name plates is solved by the present invention. The device of this invention is a C-ring that clamps around a dinner plate outer edge. The C-ring is a plastic or metal device that will resiliently attach to the edge of the dinner plate. The C-ring has a horizontal shaft extending distal from the dinner plate and a ball mounted at an upright end of the shaft. A partially circular member is movably mounted over the ball and an upwardly directed shaft from the partially circular member supports a platform for receiving a card holder or a decorative item such as a flower or a favor. By clipping the C-ring to the edge of a dinner plate or other tableware, the name of the guest is displayed or alternatively a decorative flower or party favor is displayed.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
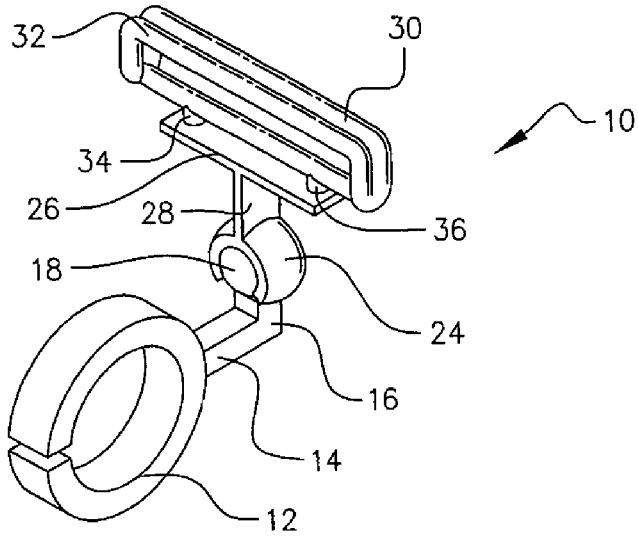
FIG. 1 is a perspective view of the clip-on device of this invention.

Throughout the following detailed description, the same reference numerals refer to the same elements in all figures.

Figure 2A:
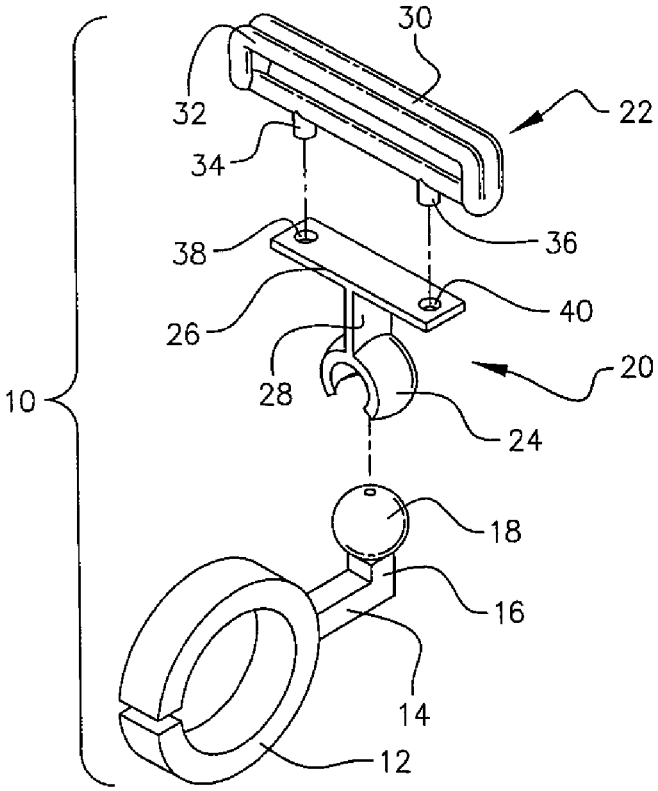
FIG. 2*a* is an exploded view of the clip-on device.
Figure 2B:
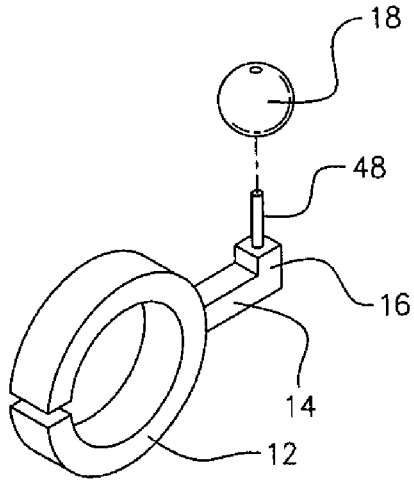
FIG. 2*b* is a perspective view of an alternate way of mounting the ball.
Figure 3:
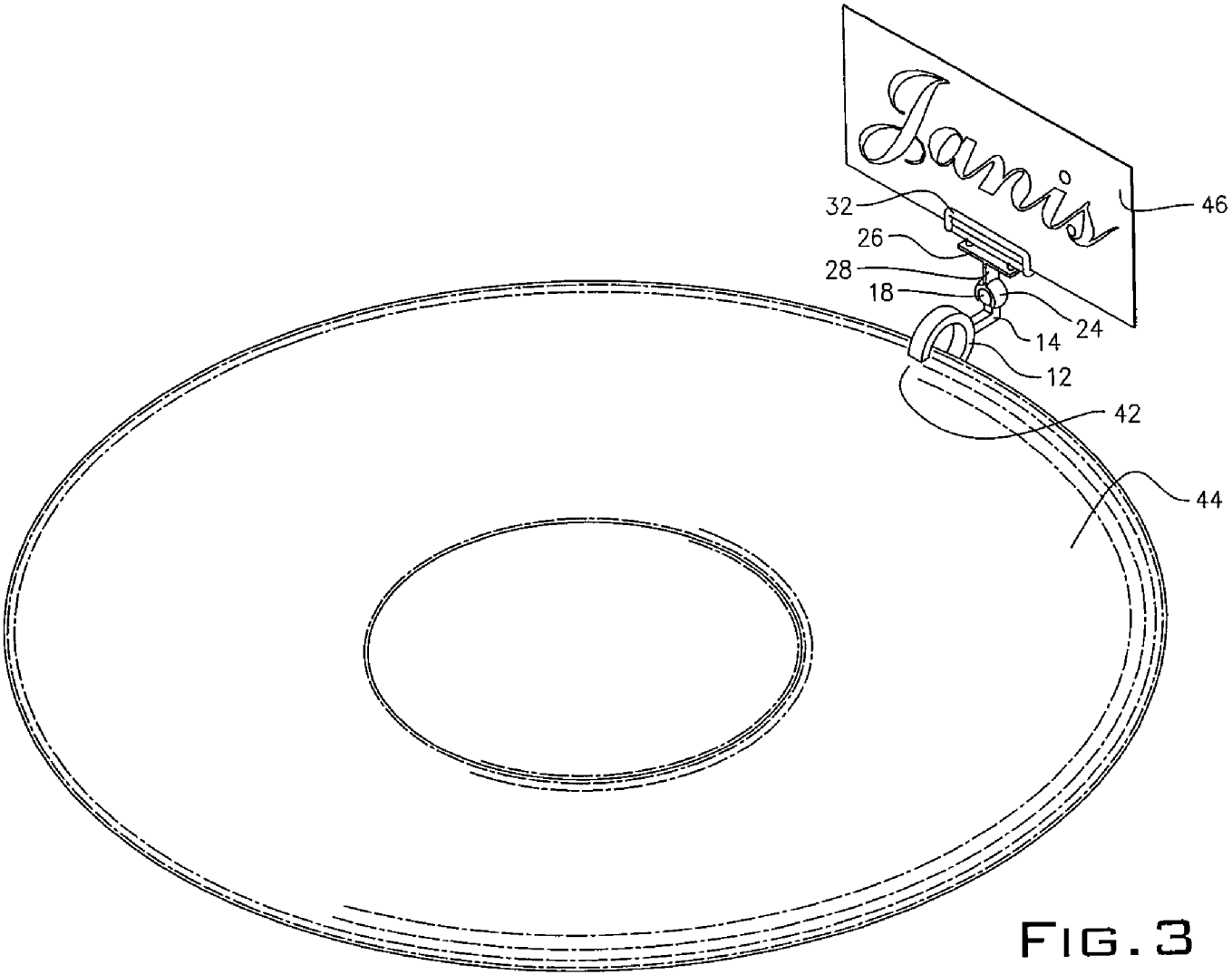
FIG. 3 is a perspective view of the clip-on device mounted on a dinner plate with an identifying name plate.

The clip-on device 10 as shown in FIGS. 1–3 is a C-ring 12 with an integral horizontally directed shaft 14. The upright end 16 of the shaft 14 supports a ball 18. The end 16 of shaft 14 can be a rod embedded in the center of ball 18.

A movable attachment to the ball 18 is a T-bar or a support 20 for a card holder 22. The support 20 has a cap in the shape of a partial circle 24 connected to a platform 26 by a strut 28. The card holder has spreadable lips 30 and 32 and downwardly directed pedestals 34 and 36 press fit into holes 38 and 40 respectively in the platform 26. As shown in FIG. 3, the C-ring 12 grips an edge 42 of a dinner plate 44. The lips 30 and 32 hold a name card 46. Alternatively lips 30 and 32 can hold the base of an ornament such as a flower or a party favor.

The slip-on device 10 can be attached to various tableware items including a dinner plate, serving tray, charger, bowl, basket, hot tray or glass.

The decorative items can include the name card 46 as well as flowers, fruits, nuts, foliage, favors, or toys.

By use of the clip-on device 10, the decorative item is movable so that the decorative item is positioned to lean over or away from the dinner plate. It can lean to the left or right depending on the decorative item employed.

The C-ring 12 and its integral shaft 14 as well as the support 20 and holder 22 are molded from a high strength plastic such as polyethylene, polypropylene or polystyrene. The ball 18 can be a molded fluorocarbon or a metal.

Equivalent elements can be substituted for the elements of the clip-on device to create substantially the same functional device in substantially the same way to achieve substantially the same results.

Having described the invention, what is claimed for Letters Patent follows:

1. A combination tableware plate and clip-on device comprising:

a tableware plate;

a C-ring adapted to grip an edge of the tableware plate;

the C-ring integral with a rearwardly extending shaft, a distal end of the shaft connected to a ball;

the ball supported by an axially mounted pin attached to the distal end of the shaft;

a means for movably gripping the ball and supporting a shelf; and a means for displaying an ornament attached to the shelf.

2. The tableware plate and clip-on device according to claim 1, wherein the means for movably gripping the ball is a frictionally engaging partial circular member.

3. The tableware plate and clip-on device according to claim 1, wherein the means for displaying an ornament is a clamping device mounted on the shelf.

* * * * *